US006086410A

United States Patent [19]

Lin

[11] Patent Number: 6,086,410

[45] Date of Patent: Jul. 11, 2000

[54] ELECTRICAL ADAPTER FOR CONNECTING MAIN WIRES

[76] Inventor: Mei-Lu Lin, No. 56, Min Sheng Street, Feng-Yuan City 42041, Taiwan

[21] Appl. No.: 09/361,673

[22] Filed: Jul. 26, 1999

[51] Int. Cl.[7] ..... H01R 4/24

[52] U.S. Cl. ..... 439/425; 439/419

[58] Field of Search ..... 439/425, 417, 439/638, 419

[56] References Cited

U.S. PATENT DOCUMENTS

| | | | |
|---|---|---|---|
| 2,745,078 | 5/1956 | Wood, Jr. | 439/425 |
| 4,941,843 | 7/1990 | Bock et al. | 439/425 |
| 5,601,448 | 2/1997 | Poon | 439/417 |
| 5,934,930 | 8/1999 | Camps et al. | 439/425 |
| 5,964,613 | 10/1999 | Huang | 439/417 |

*Primary Examiner*—Paula Bradley
*Assistant Examiner*—Tho D. Ta

[57] ABSTRACT

An electrical adapter includes a seat, a pair of conduct plates alternately secured to a pair of bent longitudinal channel in the opposite side of the seat and protected by a housing and a pair of horizontal grooves parallel extending through the center of the bottom of the seat which are engageble with a two-ply main wire. The conduct plate each has tip point projected downward from the bottom of the seat. A cap is slidably engageable into the bottom of the seat and has a pair of longitudinal grooves centrally extending through the inner surface and engageable with horizontal grooves. When the two-ply main wire engages into the horizontal grooves of the seat, the cap slidably engages with the bottom of the seat under proper pressure so as to force the tip print respectively pierced to the two-ply wire from which the electricity is supplied.

3 Claims, 8 Drawing Sheets

ELECTRICAL ADAPTER FOR CONNECTING MAIN WIRES

BACKGROUND OF THE INVENTION

The present invention relates to electrical appliances and more particularly to an electrical adapter for connecting main wires to form a network of Christmas lights to achieve greater decoration effect.

A typical electrical adapter (as shown in FIG. 1) comprises a casing 3 and pair of lean-in wires 1 and 2 entered into the casing 3 and connected two pairs of lead-out wires 1', 4 and 2', 5 which enable to respectively connect two set of the Christmas lights. This type of adapter can increase the capability of the connection of more electrical wires in order to construct network of Christmas lights. However, it has a technical limit that the user does not enable to connect more electrical wires himself to enlarge the capability of the network.

SUMMARY OF THE PRESENT INVENTION

The present invention has a main object to provide an electrical adapter which can easily and freely to connect unlimited electrical wires in order to expand network of Christmas lights as the user wishes.

Another object of the present invention is to provide an electrical adapter which is safe, durable and simple so as to economical to manufacture.

Accordingly, the electrical adapter of the present invention comprises generally a pair of conduct plates of a pair of electrical wires respectively secured to a pair of channels in opposite sides of the seat of the adapter and each including a strong tip point projected outward from a pair of first parallel grooves respectively from the bottom of the seat, and a cap enabling to couple with the bottom of the seat in a snap fitting and having a pair of second parallel grooves in the upper surface. So that when the first parallel grooves of the seat engage with a pair of additional main wires, the cap is pressed to couple with the seat thereby the main wires are connected with the adapter and the tip points of the conduct plates are automatically pierced into the main wires to supply electricity to the mainwires. Since that the electrical wire of the adapter can connect a string of Christmas lights of other main wires. So that a network is therefore established without limitations.

The present invention will become more fully understood by reference to the following detailed description thereof when read in conjunction with the attached drawings.

DETAILED DESCRIPTION OF THE PREFERRED EMBODIMENT

Figure 1:
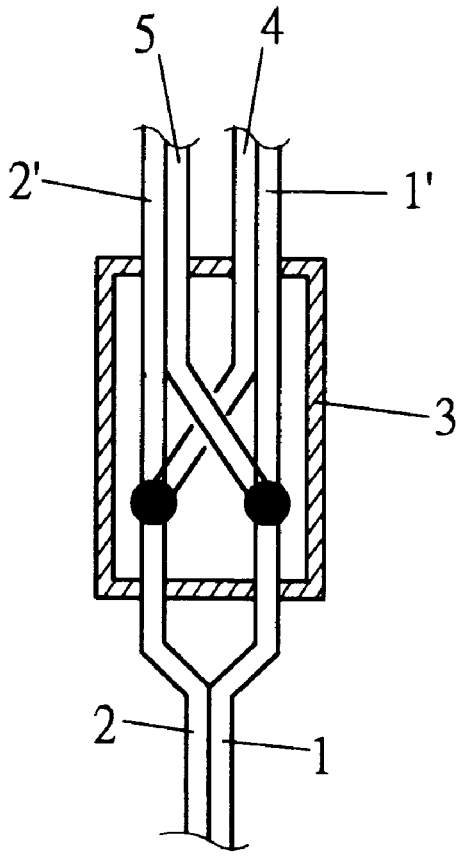
FIG.1 Prior Art
FIG. 1 is a sectional view to show an adapter of the prior art.
Figure 2:
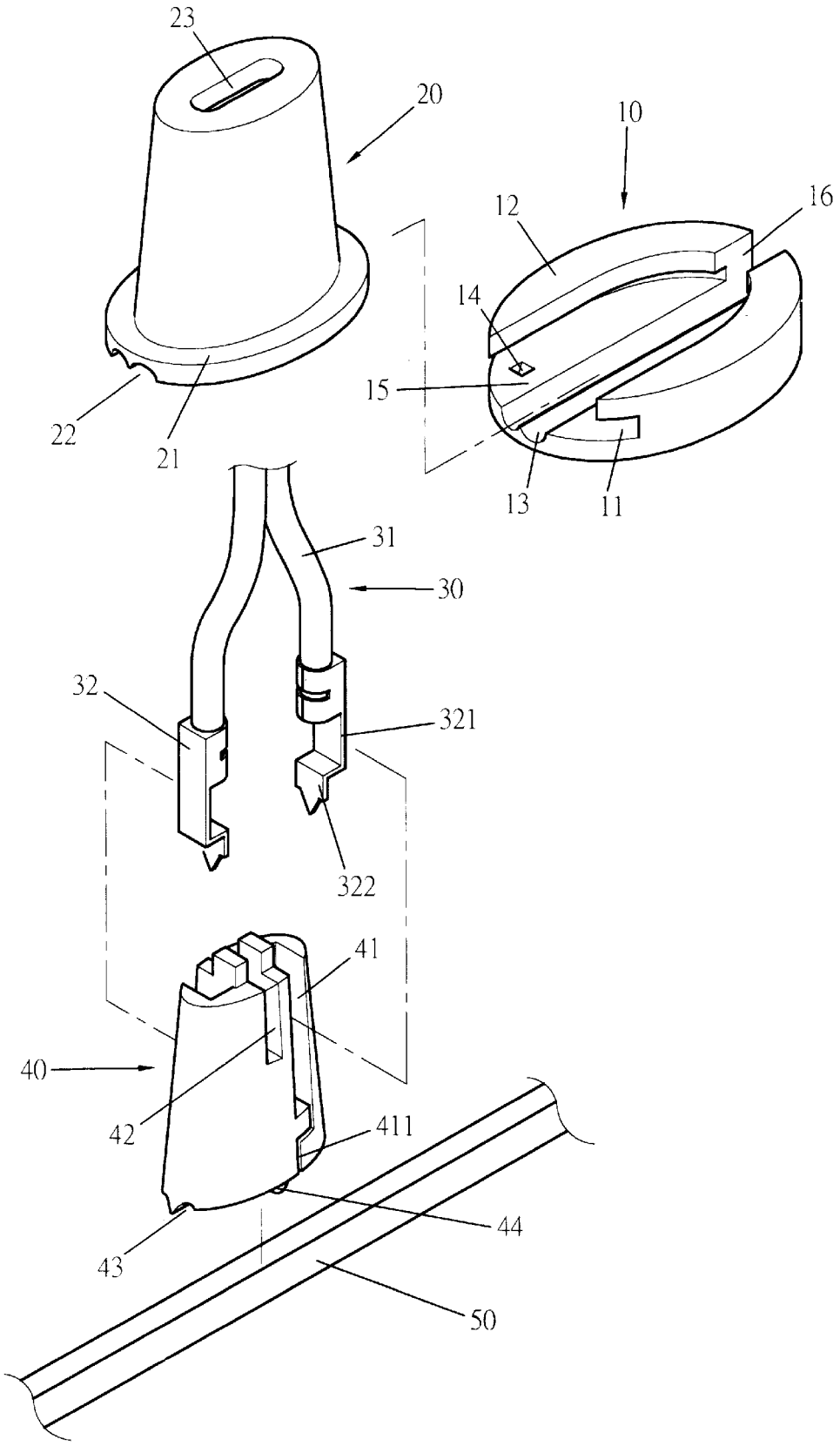
FIG. 2 is an exploded perspective view to show a preferred embodiment of the present invention.
Figure 3:
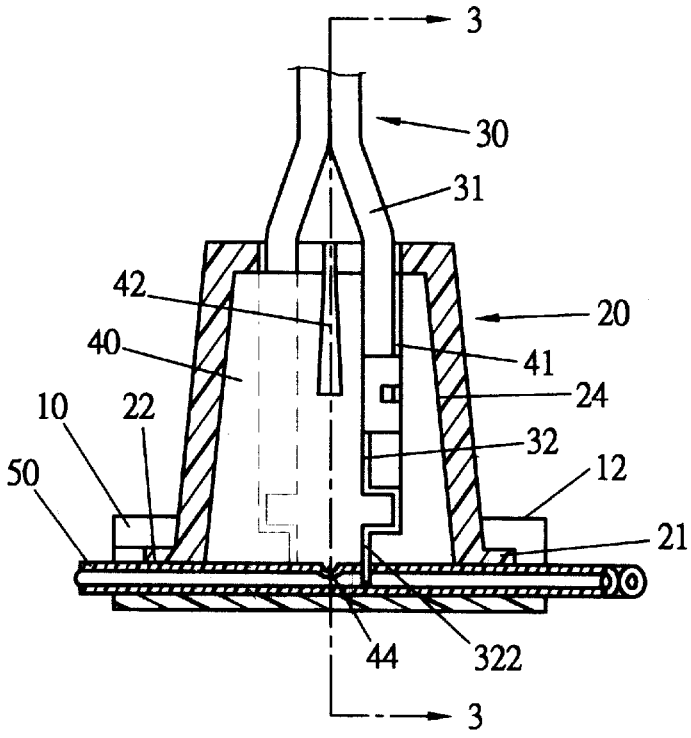
FIG. 3 is a sectional view to shown an assembly of FIG. 2.
Figure 4:
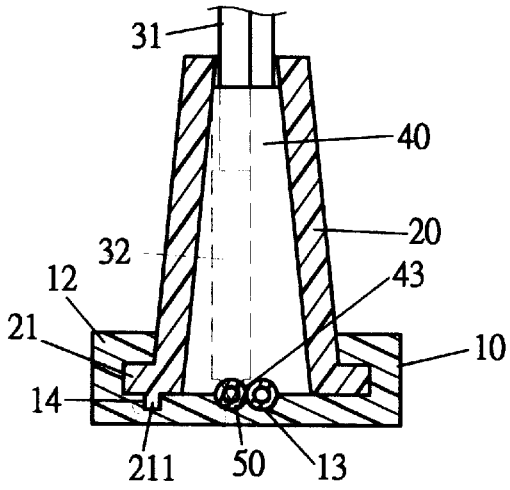
FIG. 4 is a sectional view taken from line 3—3 of FIG. 3.

With reference to FIGS. 2, 3 to 4 of the drawings, the adapter of the present invention comprises generally a cap 10, a housing 20, a pair of electrical wires 30, a seat 40 and a two-ply main wire.

The cap 10 of a flat oval body includes pair of circumferential walls on opposite sides thereof, a pair of extensions 12 extending inward from the top of the walls so as to respectively define a pair of rails 11 thereunder, a pair of longitudinal grooves 13 parallel extending in the inner surface though the center thereof, a coupling notch 14 formed adjacent one side of the grooves abutting one end thereof, a large opening 15 and a small opening 16 respectively formed in two opposing ends thereof.

The seat 40 of a generally taper body includes a large oval bottom made in registry with the shape of the cap 10, a small oval top, a pair of positioning channels 41 longitudinally and alternately formed in the opposing outer walls each having a roughly L-shaped bend 411 extending to the bottom of the seat 40, a longitudinal slot 42 centrally formed in the upper portion of the seat 40, which is for providing elasticity to tightly press against the seat 40 into the housing 20 a pair of horizontal grooves 43 parallel extending through the center of the bottom and engageable with the longitudinal grooves 13 of the cap 10, a positioning rod 211 projected downward from the bottom of the seat which is engageable with the positioning notch 14 of the cap 10 and a partition 44 projected downward from the center of the bottom of the seat 40.

The housing 20 has a shape in configuration with the outer shape of the seat 40 so as to be engageable with the seat 40, an annular flange 21 extending outward from the bottom thereof including two pair of short grooves 22 symmetrically and parallel extending in the bottom of the flange 21 at the opposing ends thereof and engageable with the longitudinal grooves 13 of the cap 1O and the horizontal grooves 43 of the seat 40 respectively and an oblong opening 23 in the top for the entrance of the lead-in wires 31.

The electrical wire 30 includes a pair lead-in wires 31 and pair of conductive plates 32 respectively connected to lower ends of the wires 31. The conductive plates 32 each having a roughly L-shaped bend 321 engageable into the L-shaped bend 411 of the channel 41 of the seat 40 and a strong tip point 322 projected downward from the L-shaped bend 321.

When assembling, first engage the conductive plates 32 into the channels 41 respectively, then sleeve the housing 20 in place onto the seat 40 having the pair of lead-in wires 31 extending out of the oblong opening 23 of the housing 20. So that the conductive plates 32 are closely protected by the housing 20 without breakaway or moving to any direction and the short grooves 22 of the housing 20 are automatically engaged with the horizontal grooves 43 of the seat 40.

In use, place the adapter onto the two-ply main wire 50 with the horizontal grooves 43 engaged with the wire 50, then slide the cap 10 onto the adapter by engaging the annular flange 21 of the housing 20 into the rails 11 of the cap 10 and pressing the cap horizontally until that positioning rod 211 of the seat 40 couples in place with the positioning notch 14 of the cap 10 in a snap fitting. So that the pair of tip point 322 of the conductive plates 32 are automatically pierced into the wires 50 respectively and separated by the partition 44, therefore connecting the electricity from the main wire 50 (as shown in FIGS. 3 and 4).

Figure 5:
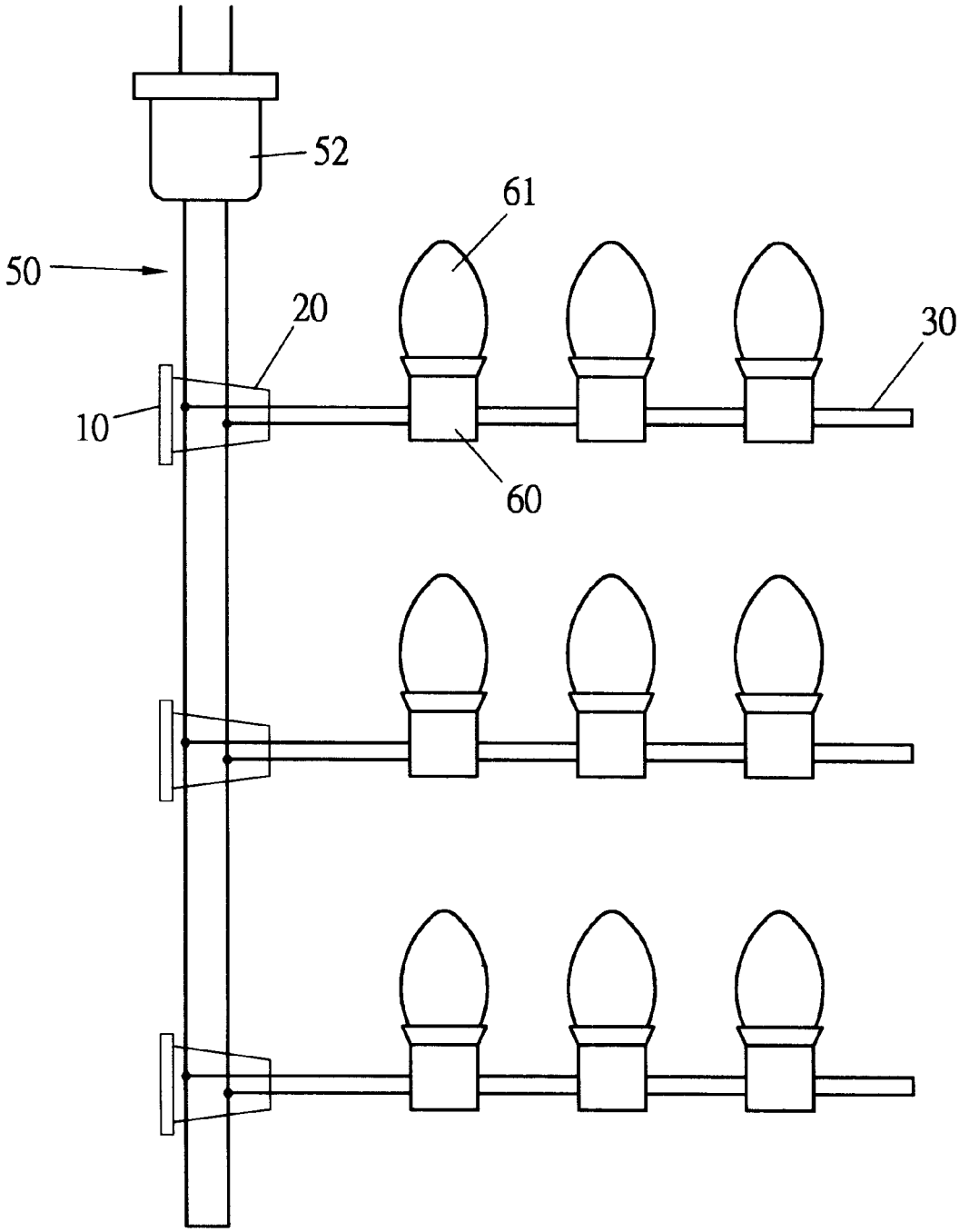
FIG. 5 is a plane view illustrating a plurality of the electrical adapters of the present invention spacedly connected to a pair of main wires.

FIG. 5 shows a plurality of electrical adapter of the present invention spacedly connected to a two-ply main wire 50 which is terminated with a plug 52 meanwhile, the electrical wires 30 from the adapter connects in series a plurality of Christmas lights 60 each including a bulb 61 in order to establish a network of Christmas light.

In this instance, the electrical wires 30 of the adapter seem perpendicular to the two-ply main wire 50. However, it can be extending to either directions if the user wants to. So that the network is versatile.

Figure 6:
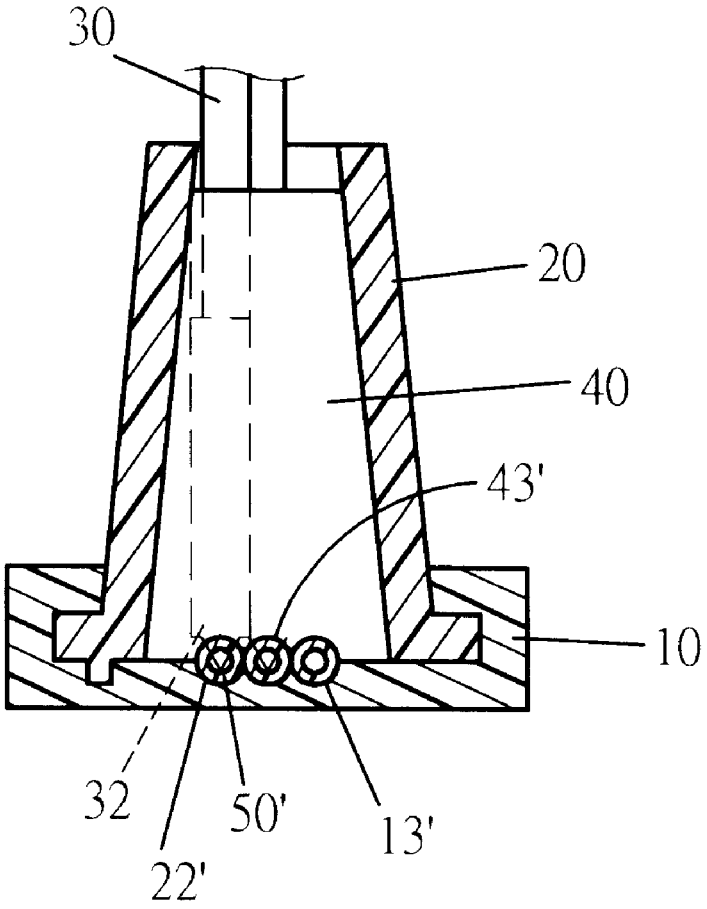
FIG. 6 is a sectional view to shown an alternative embodiment of the present invention.
Figure 7:
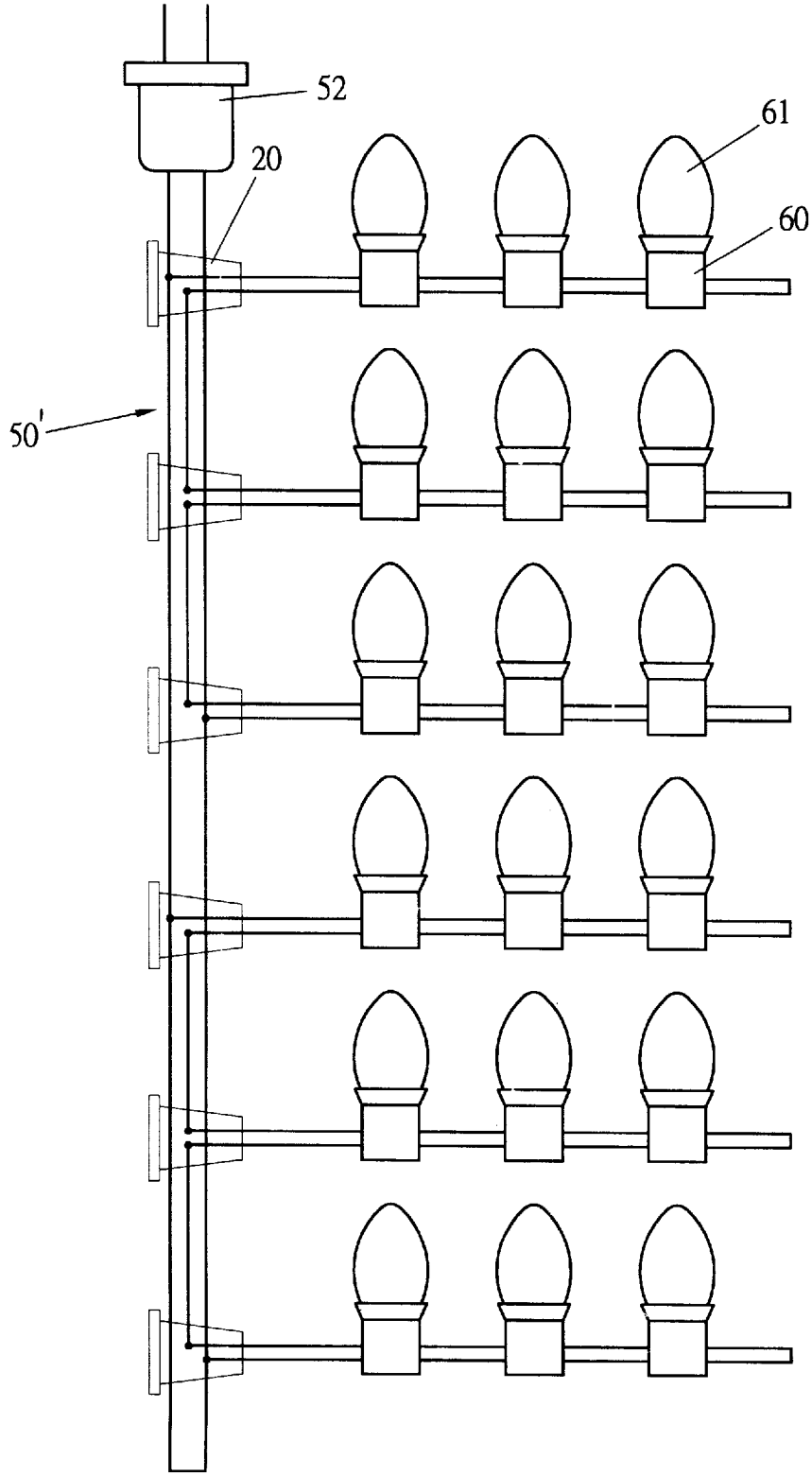
FIG. 7 is a plane view illustrating a plurality of the electrical adapters of FIG. 6 spacedly connected to three-ply wires.

Referring to FIG. 6, an alternative embodiment of the electrical adapter is provided in which the structure and function are mostly similar to the above embodiment as described in FIGS. 2–4 and above discussions are applicable in the most instances. The only modification made is that the pair of the longitudinal grooves 13 in the cap 10, now is replaced with three longitudinal grooves and resignated as 13', the pair of horizontal groove 43 in the seat 40 now is replaced with three horizontal grooves and resignated as 43', the partition 44 is now replaced with three partitions and resignated as 44', and the pairs of short grooves 22 in the housing 20 now is replaced with three short grooves and resignated as 22'. So that enables the adapter to suit to a three-ply main wire 50' (as shown in FIG. 7).

Figure 8:
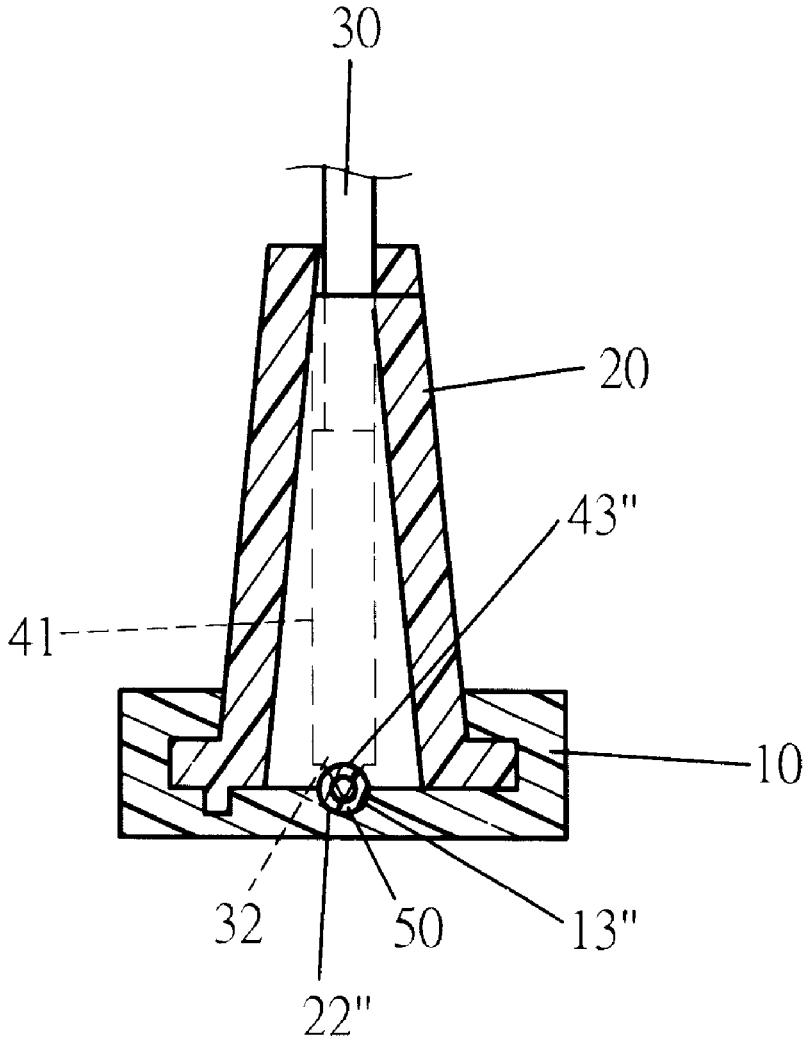
FIG. 8 is a sectional view to shown another alternative embodiment of the present invention.
Figure 9:
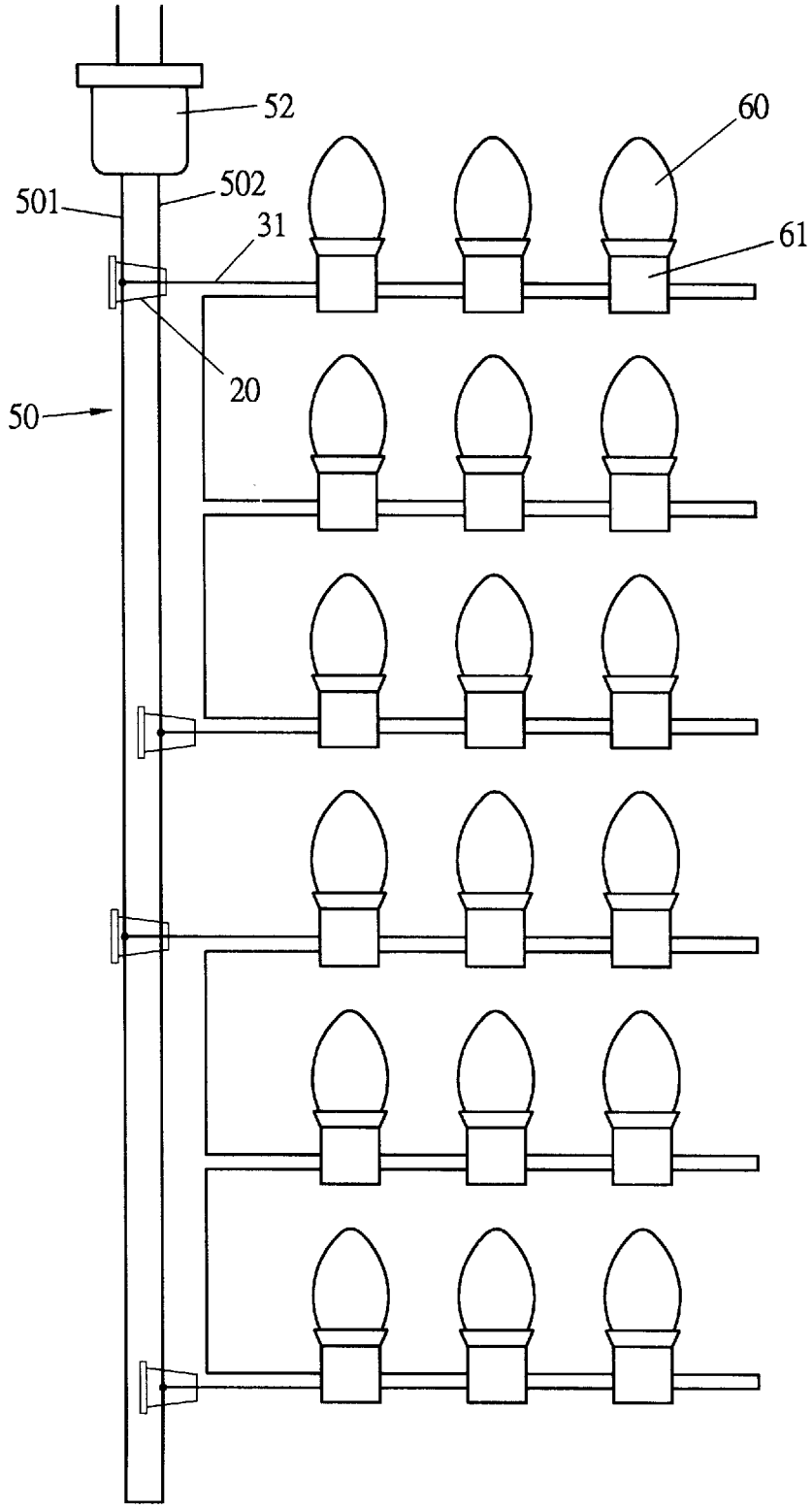
FIG. 9 is a plane view illustrating a plurality of the electrical adapters of FIG. 8 spacedly connected to a two-ply main wires.

Referring to FIG. 8, another alternative embodiment of the electrical adapter of the present invention is shown in which the structure and function are also mostly similar to the embodiment described in FIGS. 2–4, and the above discussions are applicable in the most instances. The only difference is that the pair of longitudinal grooves 13 in the cap 10 are further replaced with a single longitudinal groove and resignated as 13", the pair of horizontal groove 43 of the seat 40 are further replaced with a single horizontal groove and resignated as 43", no partitions are needed for the horizontal groove 43', and the pairs of short grooves 22 of the housing are further replaced with a pair of single short grooves and resignated as 22". Besides, only a single longitudinal channel 41 is needed for a single conductive plate 32. The conductive plates 32 of the electrical wire 30 now remain a single one too. This adapter suit to alternately connect to a single wire 501 or 502 of a two-ply wires 50 (as shown in FIG. 9).

The specification relating to the above embodiments should be construed as exemplary rather than a limitative of the present invention, with many variations and modifications being readily attainable by a person of average skill in the art without departing from the spirit or scope thereof as defined by the appended claims and their legal equivalents.

I claim:

1. An electrical adapter for electrically connecting a pair of branch wires to a two-ply main wire comprising:

a seat having a large oval shaped bottom and a small oval shaped top, said large oval shaped bottom and said small oval shaped top defining a generally taper body, a pair of longitudinal channels alternately formed in opposite outer peripheries of said body, each channel including an L-shaped bend on a lower portion of said body, a longitudinal slot centrally formed in an upper portion of said body, a pair of horizontal grooves extending parallel through the center of the large oval shaped bottom, a positioning rod projected downward form one end of the large oval shaped bottom at one side of the horizontal grooves and a partition projected downward from the center of the large oval shaped bottom between said pair of horizontal grooves;

a housing of a shape in a configuration with that of the seat, said housing sleeved onto said seat and having an oblong opening in a top thereof, an oval opening in a bottom thereof and an annular flange extending outward from the oval opening, two pairs of short grooves symmetrically formed in a bottom of the flange at two ends thereof and engageable with two ends of the horizontal grooves of said seat respectively;

a cap of a flat oval body slightly larger than the bottom of the housing and slidably engageable with the bottom of the housing, said cap having a pair of circumferential walls on opposing sides from which a pair of extensions extending inward so as to define a pair of rails thereunder to slidably engageable with the annular flange of the housing, a pair of longitudinal grooves extending parallel through the center of inner surface thereof respectively engageable with the horizontal grooves of said seat and the short grooves of said housing, a positioning notch formed adjacent one end of said cap engageable with the positioning rod of said seat, a large opening formed in said one end of said cap and a small opening formed in an opposing end of said one end of said cap;

the pair of branch wires extending outward from said seat through the oblong opening of said housing, each including a conductive plate extending downward from lower end thereof, said conductive plates being alternately engaged into the longitudinal channels of said seat and each conductive plate having an L-shaped bend engageable into the L-shaped bend of the channel and a tip point extending downward from the bottom of said seat;

when the two-ply main wire disposed parallel into the grooves of the seat, the cap is slidably engaged in place with the annular flange under proper pressure so as to force the tip points of the conductive plates respectively pierced into said two-ply main wire from which the electricity is supplied.

2. An electrical adapter for electrically connecting a pair of branch wires to a three-ply main wire comprising:

a seat having a large oval shaped bottom and a small oval shaped top, said large oval shaped bottom and said small oval shaped top defining a generally taper body, a pair of longitudinal channels alternately formed in opposite outer peripheries of said body, each channel including an L-shaped bend on a lower portion of said body, a longitudinal slot centrally formed in an upper portion of said body, three horizontal grooves extending parallel through the center of the large oval shaped bottom, a positioning rod projected downward form one end of the large oval shaped bottom at one side of the horizontal grooves and a pair of partitions projected downward from the center of the large oval shaped bottom between said three horizontal grooves;

a housing of a shape in a configuration with that of the seat, said housing sleeved onto said seat and having an oblong opening in a top thereof, an oval opening in a bottom thereof and an annular flange extending outward from the oval opening, two pairs of three short grooves symmetrically formed in a bottom of the flange at two ends thereof and engageable with two ends of the three horizontal grooves of said seat respectively;

a cap of a flat oval body slightly larger than the bottom of the housing and slidably engageable with the bottom of the housing, said cap having a pair of circumferential walls on opposing sides from which a pair of extensions extending inward so as to define a pair of rails thereunder to slidably engageable with the annular flange of the housing, three longitudinal grooves extending parallel through the center of inner surface thereof respectively engageable with the horizontal grooves of said seat and the short grooves of said housing, a positioning notch formed adjacent one end of said cap engageable with the positioning rod of said seat, a large opening formed in said one end of said cap and a small opening formed in an opposing end of said one end of said cap;

the pair of branch wires extending outward from said seat through the oblong opening of said housing, each including a conductive plate extending downward from lower end thereof, said conductive plates being alternately engaged into the longitudinal channels of said seat and each conductive plate having an L-shaped bend engageable into the L-shaped bend of the channel and a tip point extending downward from the bottom of said seat;

when the three-ply main wire disposed parallel into the grooves of the seat, the cap is slidably engaged in place with the annular flange under proper pressure so as to force the tip points of the conductive plates respectively pierced into wires of said three-ply main wire from which the electricity is supplied.

3. An electrical adapter for electrically connecting a branch wire to a single main wire comprising:

a seat having a large oval shaped bottom and a small oval shaped top, said large oval shaped bottom and said small oval shaped top defining a generally taper body, a longitudinal channel formed in an outer periphery of said body, said including an L-shaped bend on a lower portion of said body, a longitudinal slot centrally formed in an upper portion of said body, a single horizontal groove extending parallel through the center of the large oval shaped bottom, a positioning rod projected downward form one end of the large oval shaped bottom at one side of the horizontal grooves;

a housing of a shape in a configuration with that of the seat, said housing sleeved onto said seat and having an oblong opening in a top thereof, an oval opening in a bottom thereof and an annular flange extending outward from the oval opening, two single short grooves symmetrically formed in a bottom of the flange at two ends thereof and engageable with two ends of the single horizontal groove of said seat respectively;

a cap of a flat oval body slightly larger than the bottom of the housing and slidably engageable with the bottom of the housing, said cap having a pair of circumferential walls on opposing sides from which a pair of extensions extending inward so as to define a pair of rails thereunder to slidably engageable with the annular flange of the housing, a single longitudinal groove extending parallel through the center of inner surface thereof respectively engageable with the single horizontal groove of said seat and the short grooves of said housing, a positioning notch formed adjacent one end of said cap engageable with the positioning rod of said seat, a large opening formed in said one end of said cap and a small opening formed in an opposing end of said one end of said cap;

the branch wire extending outward from said seat through the oblong opening of said housing, said branch wire including a conductive plate extending downward from lower end thereof, said conductive plate being engaged into the longitudinal channel of said seat and having an L-shaped bend engageable into the L-shaped bend of the channel and a tip point extending downward from the bottom of said seat;

when the single main wire disposed into the single horizontal groove of the seat, the cap is slidably engaged in place with the annular flange under proper pressure so as to force the tip point of the conductive plate respectively pierced into said single main wire from which the electricity is supplied.

* * * * *